US005511482A

United States Patent [19]

DiPietropolo

[11] Patent Number: 5,511,482

[45] Date of Patent: Apr. 30, 1996

[54] ENVIRONMENTALLY DEGRADABLE MUNITIONS

[76] Inventor: Al DiPietropolo, 701 Park Dr., Cherry Hill, N.J. 08002

[21] Appl. No.: 272,597

[22] Filed: Jul. 11, 1994

[51] Int. Cl.[6] ..... F42B 12/00

[52] U.S. Cl. ..... 102/426; 102/293; 89/1.11

[58] Field of Search ..... 102/293, 401, 102/406, 408, 426, 481; 86/50; 89/1.11, 1.13

[56] References Cited

U.S. PATENT DOCUMENTS

| | | | |
|---|---|---|---|
| 1,229,797 | 6/1917 | Schneider | 102/416 |
| 2,465,009 | 3/1949 | Chase | 102/416 |
| 3,447,461 | 6/1969 | Lapof | 102/8 |
| 3,464,354 | 9/1969 | Skinner | 102/8 |
| 3,575,110 | 4/1971 | Conroy et al. | 102/8 |
| 3,667,387 | 6/1972 | Picard | 102/426 |
| 3,909,497 | 9/1975 | Hendry et al. | 260/77.5 A |
| 4,411,199 | 10/1983 | Yates et al. | 102/481 |
| 4,493,239 | 1/1985 | Pedersen | 102/426 |
| 4,711,179 | 12/1987 | Sundberg | 102/426 |
| 5,035,481 | 7/1991 | Jacks et al. | 102/481 |
| 5,135,966 | 8/1992 | Chatterjee et al. | 523/126 |
| 5,216,043 | 6/1993 | Sipinen et al. | 523/126 |
| 5,223,661 | 6/1993 | Sabri | 89/1.13 |
| 5,258,422 | 11/1993 | Chang et al. | 523/126 |
| 5,263,417 | 11/1993 | Godfrey-Phillips | 102/453 |
| 5,370,845 | 12/1994 | Miller et al. | 422/186.3 |

FOREIGN PATENT DOCUMENTS

| | | | |
|---|---|---|---|
| 2172968 | 10/1986 | United Kingdom | 102/452 |
| 2172969 | 10/1986 | United Kingdom | 102/467 |
| 9218826 | 10/1992 | WIPO | 102/466 |

*Primary Examiner*—Charles T. Jordan
*Assistant Examiner*—Theresa M. Wesson
*Attorney, Agent, or Firm*—Panitch Schwarze Jacobs & Nadel

[57] ABSTRACT

A munition which remains uninitiated after deployment undergoes a process of self-neutralization. This process is accomplished through the use of environmentally degradable materials in the construction of the ordnance items. The degradable components comprising the device fail in a predetermined manner and within a known time frame. The resultant neutralization may be manifested in a myriad of ways. The type of degradable material, its position within the munition, its mass, and many other factors, will all determine the ultimate characteristics of the device.

The neutralization may be realized through detonation, burning and, disassociation of interactive components which will cause deactivation, reduced lethality or intensity of the device, dispersion of the main charge, or the dispersion of one or more of the initiation charges comprising the munition.

7 Claims, 4 Drawing Sheets

ENVIRONMENTALLY DEGRADABLE MUNITIONS

TECHNICAL FIELD

The present invention relates to ordnance devices such as mines, bombs, bomblets, projectiles, mortars, grenades, and other munitions which, after deployment, self-neutralize through the use of environmentally degradable materials that were used in their construction or assembly. The interaction of the degradable materials with the natural environment causes predetermined failure of one or more of the components comprising the device, thereby causing the neutralization of the item. The neutralization may be realized through detonation, burning, and disassociation of interactive components which will cause deactivation, reduced lethality or intensity of the unit, dispersion of the main charge, or the dispersion of one or more of the initiation charges comprising the device.

Deployed munitions are difficult to neutralize should they fail to function. Alternatively, they may not have been triggered or otherwise appropriately agitated by enemy forces, or are no longer necessary (such as mines that have been deployed but the area is no longer strategically important). These items are descriptively referred to as "duds" or, more accurately, as unexploded ordnance. The very dangerous task of locating these devices is often extremely difficult and time-consuming. Once found, their questionable physical condition and degree of sensitivity to initiation or release of their contents continues to represent a deadly threat. Not infrequently, the devices are damaged and in varying states of deterioration. Consequently, their susceptibility to inadvertent detonation or content release may be extremely high. The complete process of locating, isolating, disarming, and destruction of these items is fraught with danger and represents a time-intensive endeavor that is expensive to accomplish and is unfortunately, often incomplete in accomplishment.

SUMMARY OF THE INVENTION

The object of the present invention is to provide a means by which a deployed munition, in an armed but no longer useful state, is neutralized through its interaction with the environmental elements of nature to which it is continuously exposed. The neutralization process is accomplished through the use of degradable materials in the construction of the device or in the components comprising the mechanisms responsible for arming, initiating or maintaining the device in an armed state. For example, by using a degradable housing or containment assembly for the detonator, the degradation and eventual separation of the assembly due to its exposure to the environment may be designed to cause the detonator to separate itself from the main charge, thus rendering the explosive device safe to handle. Alternatively, the degradation of the containment device may be designed to cause the detonator to explode the main charge by releasing a firing mechanism to initiate the detonator. This can be accomplished in a multitude of ways. One readily achievable method would be for the degradable material to maintain a blockage within the path of the firing mechanism. Once the degradable material becomes sufficiently weakened, the tensioned firing mechanism, a spring-loaded firing pin for this example, will forcefully penetrate the much compromised blockage and strike the detonator with sufficient force to complete the firing sequence.

It is intended that the present invention will utilize one or more of the many different types and formulations of degradable plastics to comprise this new type of ordnance. Of the many variations of degradable plastics, there are several which presently offer characteristics applicable to this invention. One such grouping of compositions is from the family consisting of ethylene-vinyl alcohol, polyvinyl alcohol, and similar compounds. The rate at which biodegradability occurs is determined, in part by the percentage of carbonyl and destructured starch in the material. Other factors affecting the rate of degradability are: the thickness of the plastic material, the surface area exposed to the environment, the humidity and bacteria levels present, temperature, and the duration and intensity of sunlight encountered.

Among the earliest biodegradable plastics were the olefinic polymers and the cornstarch filled polyethylene films. More environmentally responsive degradables with higher performance characteristics have more recently been developed. These include the co-polyesters such as the polyglycolides and polylactides. Photodegradable polyethylenes have also achieved a high level of development, and are most applicable for munitions deployed on the surface of the ground. A very promising addition to the biodegradable plastic family is the group of polyester polymers comprised of hydroxybutyrate with hydroxyvalerate units randomly dispersed throughout the polymer chain. This family of thermoplastic polyesters degrades through its exposure to microorganisms which metabolizes the polymer. Complete conversion is achieved under aerobic or anaerobic conditions. These polyhydroxybutyrate-valerate polymers have excellent physical characteristics, degrade in all environments, and are very stable under most storage conditions. The ultimate performance characteristics of this material is primarily determined by its hydroxyvalerate content. Cellulose-based resins also represent an effective material choice for this invention. Their cost is low and the rate of biodegradability is quite predicable and can readily be varied to meet specific requirements.

One skilled in the art of degradable plastics can provide a formulation offering the appropriate degree of biodegradability depending upon the environmental and performance characteristics desired. It is expected that each type of munition will require a specific degradable plastic composition to achieve optimal performance characteristics. Anticipated environmental factors must also be considered. Prior to arriving at the final design of a degradable munition, it must also be decided over how long a period of time the device must be viable. For example, once fired, a howitzer or cannon projectile is of no use to friendly forces once it has impacted at the target site and malfunctioned. However, enemy troops may find it beneficial to salvage these munitions for fabrication into booby traps or to retrieve the contained explosives for later use. In this type of scenario it would be best if the unexploded projectile had selected components which undergo rapid degradation. Typically, the failure of a projectile to detonate is caused by a malfunctioning fuze or a fuze which had not been properly set. Consequently, a secondary firing mechanism associated with the main fuze but relying upon the degradation of a specific component or components within this secondary system to initiate the firing sequence will have several advantages. It will minimize the likelihood of the enemy retrieving unexploded projectiles for later use against our forces. Understandably, the danger to civilians will be greatly reduced through the elimination of armed projectiles scattered throughout the area. Subsequent to the conflict, less danger and expense will be incurred in manually neutralizing unexploded munitions in preparation for returning the land to general use.

A buried land mine may be required to remain functional for a number of months before neutralization is desired. Conversely, there are other munitions which will never be buried and can rely solely upon the photodegradability aspect of this invention to achieve neutralization. For example, cluster bombs, which upon their release from an aircraft, eject a quantity of small explosive devices generally known as bomblets which blanket a section of terrain. Generally, these devices are designed to either explode upon impact or through agitation by the enemy. These submunitions typically come to rest on the surface of the ground and may remain armed for an indefinite period. As an added dilemma, the malfunction rate within this grouping of munitions is quite high. Paradoxically, once an area is saturated with the bomblets, the tactical significance of the region is generally short-lived. Therefore, if only for humanitarian considerations of the general populace, it would be best if these devices were neutralized shortly after their usefulness has expired. Otherwise, neutralization after the conflict utilizing traditional methods will be prohibitive in cost and risk to human life.

To safeguard against the premature initiation of the degradation process, munitions in storage, transport or those awaiting use in the field should be protected from environmental influences. This is readily and inexpensively addressed by employing methods similar to those currently used for the protection of non-degradable munitions. The type of munition and its intended deployment mode will dictate the means and type of environmental protection required. For example, cluster bombs comprised of degradable bomblets will not require additional protection or isolation beyond that which is currently used. Similarly, land mines and mortar rounds are generally retained in their packaged state up to the time of their deployment. Consequently, they should not require supplemental protection. Conversely, artillery projectiles are typically unprotected and often exposed to the environment for extended periods. However, these munitions will probably have their degradability aspect restricted to the fuze component. Generally, fuzes are well-protected and isolated from the environment and their associated projectiles until shortly before deployment. If alternative or enhanced environmental protection is deemed necessary it can be readily achieved through packaging methods such as moisture-resistant fiber containers, plastic pouches, wraps, and similar materials, methods, and configurations currently available.

One preferred embodiment of the invention, a land mine for example, will have the outer container of the munition which heretofore has been made of a durable metal or plastic material replaced with a degradable product. The result is a high explosive, chemical or biological releasing container which, within a predetermined time-frame, degrades and breaks up, thereby exposing and releasing its contents to become dispersed within the environment, as would be the case with a charge of flaked explosives, or whose contents consisted of biological or chemical materials in a gaseous, liquid, powdered or other readily dispersible state.

Neutralization may also occur through the degradation of a component holding the firing mechanism and/or detonator to the body of the munition, thereby causing the detonator to become separated from the booster or main charge. The munition can be designed to degrade in numerous ways. One method would be for the outer housing of the munition to be made of a degradable material. Upon exposure to the environment, the housing gradually degrades, thus causing the housing to rupture, fragment, or otherwise separate into two or more pieces. The fragments may cause the detonation of the main charge by causing the initiation of the firing sequence. Another result of the fragmentation of the outer housing would be to cause the main explosive charge to become separated from the detonator or, if part of the assembly, the separation or isolation of the booster charge. The separation of either of these vital components would in effect, minimize much of the danger associated with the device. Still another result of the separation of the main housing of the munition would be to enable the main charge to become dispersed within the environment. This will generally require that the main charge be comprised of a flaked, granular, gas, gel, liquid, or other form readily separable into smaller or less confined constituent parts to achieve effective dispersion within the environment. The degradation and subsequent separation of the main housing would expose its contents, the main charge, to the forces of nature, thus causing its dispersion and associated neutralization.

The neutralization process may be taken a step further by having the housing for the detonator comprised of the same or similar degradable material. Thus, deployment of the explosive device will cause its detonator to become exposed to the environment. The ensuing degradation of the detonator's housing will cause its neutralization through the exposure of the components comprising the detonator to the environment. Detonators are typically comprised of moisture-sensitive chemical compounds and generally require that these compounds be in a compacted and confined state to be effective. Once the detonators) has been neutralized, the munition is relatively safe to handle, thereby minimizing the danger to human life.

Separation points of the munition's housing may be predetermined through the identification of specific locations for the placement of an uneven or undulating surface possessing increased surface area at the point or locations where the housing is to separate or otherwise become opened or accessible to the environment. The increased surface area enhances the rate of degradation, due of course, to that specific section or sections experiencing enhanced exposure to the environment. Consequently, these areas of increased exposed surfaces will degrade at a faster pace than the smoother, more regularly surfaced sections. It will be at these locations of increased surface area that the material will fail. Final separation may be aided through the inclusion of springs located within the device to forcibly assist in the separation of the components as the degradation process progresses. This forceable separation of the components may also be employed to activate the device. It should be evident that the degradation process can be designed to impart a multitude of responses from the munition.

It may be desirable to have certain ordnance items comprised predominantly of plastics and more specifically, degradable plastics. Fabrication or construction from this material will minimize their detection by enemy forces using currently available mine detecting instruments. Similarly, battery powered timers and their associated electronics may be replaced by degradable plastics. Not only is detection by enemy forces reduced by the absence of these electronic elements, but more space within the munition is available for explosive or other charge material, thereby increasing the effectiveness of the munition. concurrently, the financial cost and overall weight of each item is reduced through the elimination of the batteries, timers, and other electronic components. Reliability is also enhanced due to the unavoidable degradation of the item once it is placed in the environment and its total lack of dependence upon electronic or mechanical means to achieve its functional objective.

The actual amount of degradable material used in each device may comprise but a small portion of the overall mass comprising the munition. A narrow band of degradable material may be used to join the two or more housing components together. Alternatively, strategically placed fasteners may be comprised of the degradable material. This may be taken to its minimal presence by having an interference type pin blocking a secondary firing mechanism until such time as the pin degrades and begins to fragment. Thus, the path of the firing pin is cleared and its associated spring tension or other means of energy permits it to function by impacting upon the detonator, thereby causing the initiation of the device. Under relevant circumstances, such as when the device is required to remain functional for an indefinite period, the degradable pin may be replaced by one comprised of a durable material such as metal or non-degradable plastic. An arrangement of this nature dictates that detonation or activation of the munition will require alternative means of initiation. Such devices will remain effective until such time as they are initiated by the enemy or neutralized by alternative means.

While the method of this invention has been shown and described with reference to specific embodiments it will be understood by those skilled in the art that many in deviations in form and specific details may be made therein without departing from the scope of the invention which is limited only by the claims annexed hereto.

DISCUSSION OF THE PRIOR ART

Heretofore, unexploded ordnance posed a serious threat to military and civilian personnel. Once located, the generally employed method of dealing with these dangerous devices is to detonate them where they lie or to transport them to a safer location for detonation or burning. Destruction is typically accomplished by placing explosive charges among the unexploded ordnance items and then initiating the explosion and ensuing destruction from a safe distance. Alternatively, the devices may be amassed and burned at a safe location. Devices too dangerous to handle or transport, such as armed mines and bomblets may be neutralized by traversing the area with giant mechanized rollers or drag chains. Understandably, this is an expensive and time-consuming procedure, and one which normally requires re-working the area with heavier follow-up rollers to destroy deeper laid devices and to confirm the effectiveness of the neutralization process prior to returning the land to general use.

To facilitate the identification and neutralization of unexploded ordnance a number of methods have evolved. One, as described in U.S. Pat. No. 4,711,179 embodies a land mine which, upon deployment in an armed state will, after a predetermined length of time, disarm itself and eject a marker to identify the location of the disarmed mine. This device is less than desirable in several respects. The disarming mechanism and the spotting charge used in the ejecting stage requires numerous electronic and mechanical components, including a timer, battery, and motor. These items must necessarily, either increase the size of the mine or mandate that a reduced explosive charge be employed. Further, the sophistication of the ejection and marker provisions add considerably to the expense of the device with its associated complexity negatively impacting upon the overall reliability and general acceptance by the military. Additionally, the highly visible marker is more likely to be discovered by enemy forces than not. Understandably, it is within the enemy's expected path of travel that the device was initially deployed. Consequently, once they spot the marker, a readily identifiable path to a free and safe source of reuseable explosives is provided.

U.S. Pat. No. 3,447,461 reveals an antipersonnel mine which is self-neutralizing through the utilization of an internal water reservoir or through the admission of atmospheric moisture to the interior of the device via numerous apertures. The dispersion of the moisture within the confines of the mine causes a suitable medium to become engorged and enlarged, thus initiating a series of events culminating in the movement of an obstruction between the firing pin and the detonator. This device does not lend itself well to long-term storage and adds unnecessarily to the size and weight of the munition. The portals which permit moisture to be introduced into the mine are easily clogged under typical deployment conditions.

A deactivation means is incorporated into the design offered in U.S. Pat. No. 3,464,354. The disarming mechanism relies upon the device's loss of pressurization over time. The time interval for the deactivation is not known. Deactivation relies upon the assumption that a permanent air pressure seal is unachievable. The premise is that once deployed, the device's pressurization will last no longer than a few years. The pressurization is also the force used to drive the firing pin into the detonator. Consequently, once pressure is lost, there no longer exists the required energy to propel the firing pin; and the device becomes deactivated. The reliance upon gas seals and pressurization of this design may prove dangerous in hostile environments. It is highly susceptible to changes in temperature and altitude. Most certainly it would be disconcerting to those individuals arming the device. Additionally, the arming process can be a very dangerous procedure requiring many fail-safe provisions to protect personnel, especially under hostile battlefield conditions. The design of the device limits its use to the larger more infrequently encountered styles of land mines.

U.S. Pat. No. 3,667,387 discloses a self-destructing land mine. The self-neutralizing process is initiated by the rupturing of internally contained glass vials containing a solvent. This solvent reacts with a nitrocellulose outer film. The eventual dissolution of the nitrocellulose film causes the confined phosphorus to become exposed to the atmosphere, thus initiating the violent destruction of the mine. This land mine is so dangerous that it must be stored and transported submerged in water. Otherwise, should one or more of the internal glass vials rupture, the ensuing atmospheric exposure of the phosphorus will have catastrophic results. Logistically, it is unrealistic to transport large quantities of this device in a hostile environment while maintaining them submerged in water.

Another method of eliminating the dangers of unexploded ordnance is described in U.S. Pat. No. 4,493,239. The patent discloses a process of enhanced oxidation of buried aluminum and ferrous ordnance through the establishment of a continuous flow of direct current electricity through the soil medium. This continuous flow of electricity may be enhanced through the constant saturation of the ground up to a depth of three feet with a saline solution to enhance the oxidation process. Nevertheless, the complete regimen may take up to ten years. This prolonged process is impractical for use in most locations and prohibitively expensive where it could be employed. The isolation of the involved land from general useage during this period will be difficult to achieve.

Other devices are known which, once their electrically energized systems, generally sourced by a battery, is all but depleted, neutralization of the munition is accomplished through self-detonation. Devices of this type are more readily detected due to their electrical pulses. They also tend to be very expensive to produce and are subject to significant malfunctions due to variations of the electrical circuit caused by hostile exposure conditions, short circuits and variable output of their electrical systems. These same electromagnetic fields enhance the discovery of these devices by enemy forces utilizing mine detecting instruments.

The electronic initiation of the neutralization process poses special problems when applied to bomblets, which are the individual explosive devices comprising cluster bombs. Due to their relatively small size, space is of paramount importance and can not afford to be given up to accommodate the electronics required to initiate and complete the neutralization process. Additionally, bomblets experience a very high failure rate once deployed. Consequently, their very inability to function may very well prevent any self-neutralization process from taking place.

The need for an effective degradable munition is exemplified by the proliferation of attempts to produce self-neutralizing ordnance. Under the present invention, a simpler, more efficient, reliable, and less costly method of achieving this end is disclosed.

DESCRIPTION OF THE DRAWINGS

The invention will now be described by way of example only, with reference to the accompanying drawings in which:

FIG. I is a cross-sectional view of a typical projectile fuze, in this case a point detonating fuze.

Figure 1:
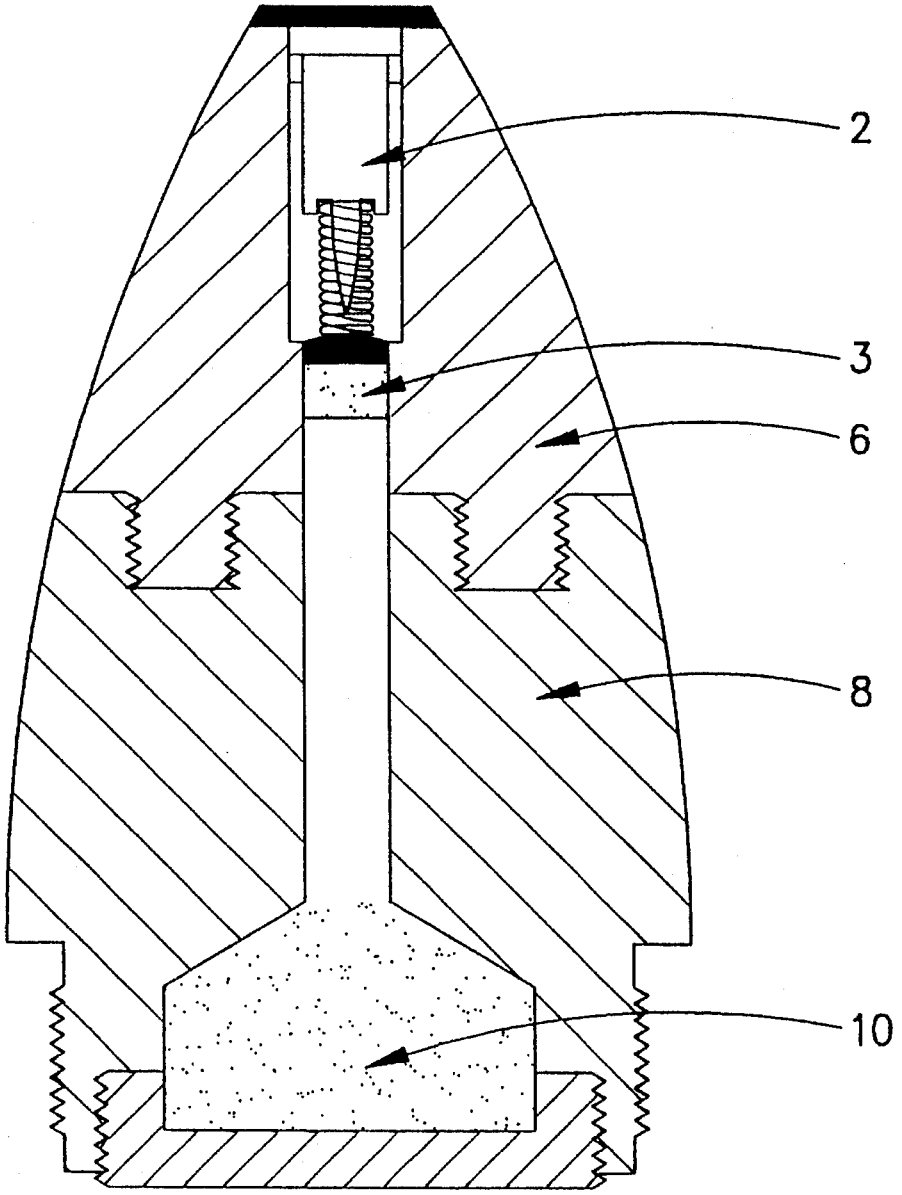
Figure 2:
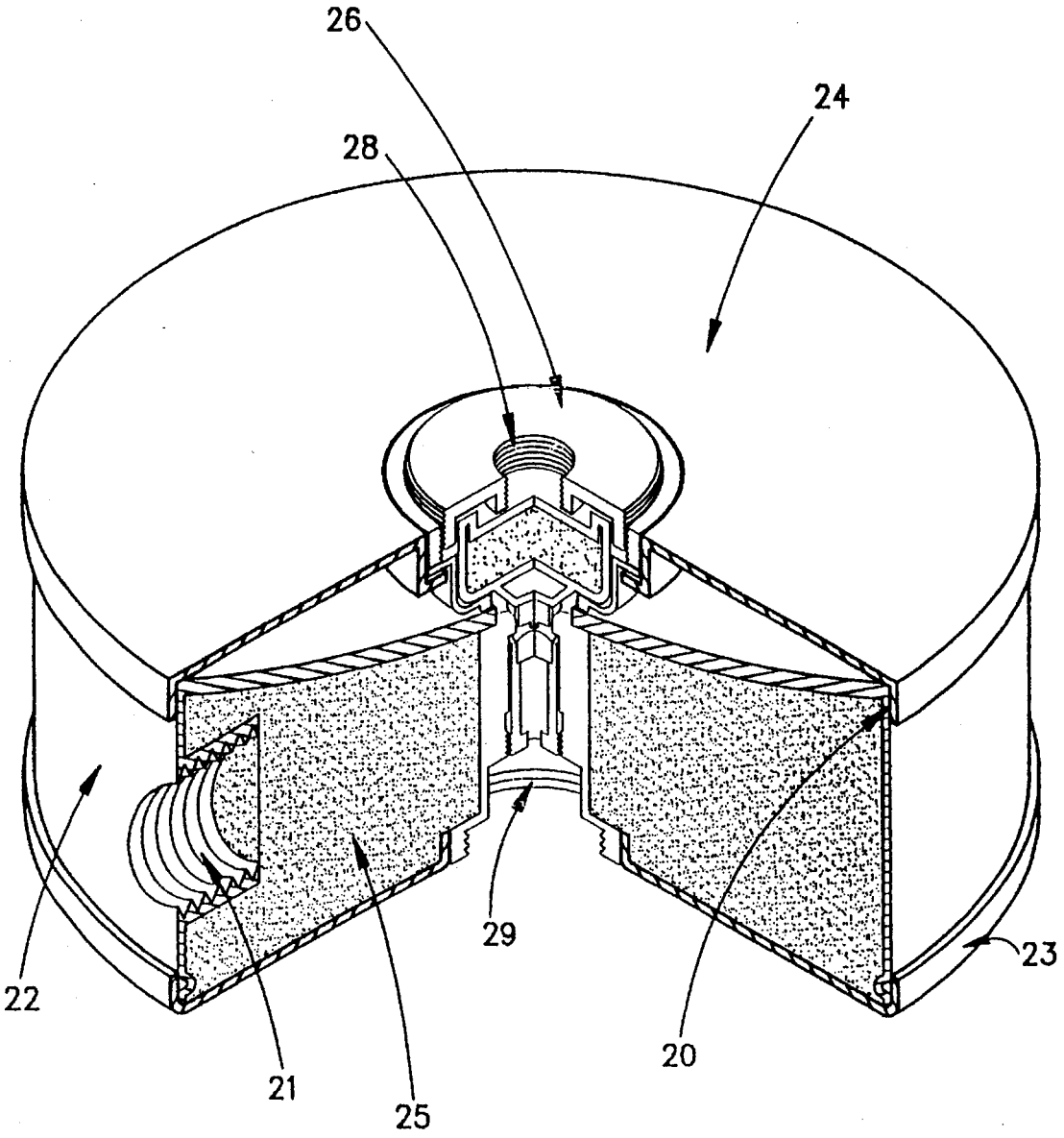
Figure 3:
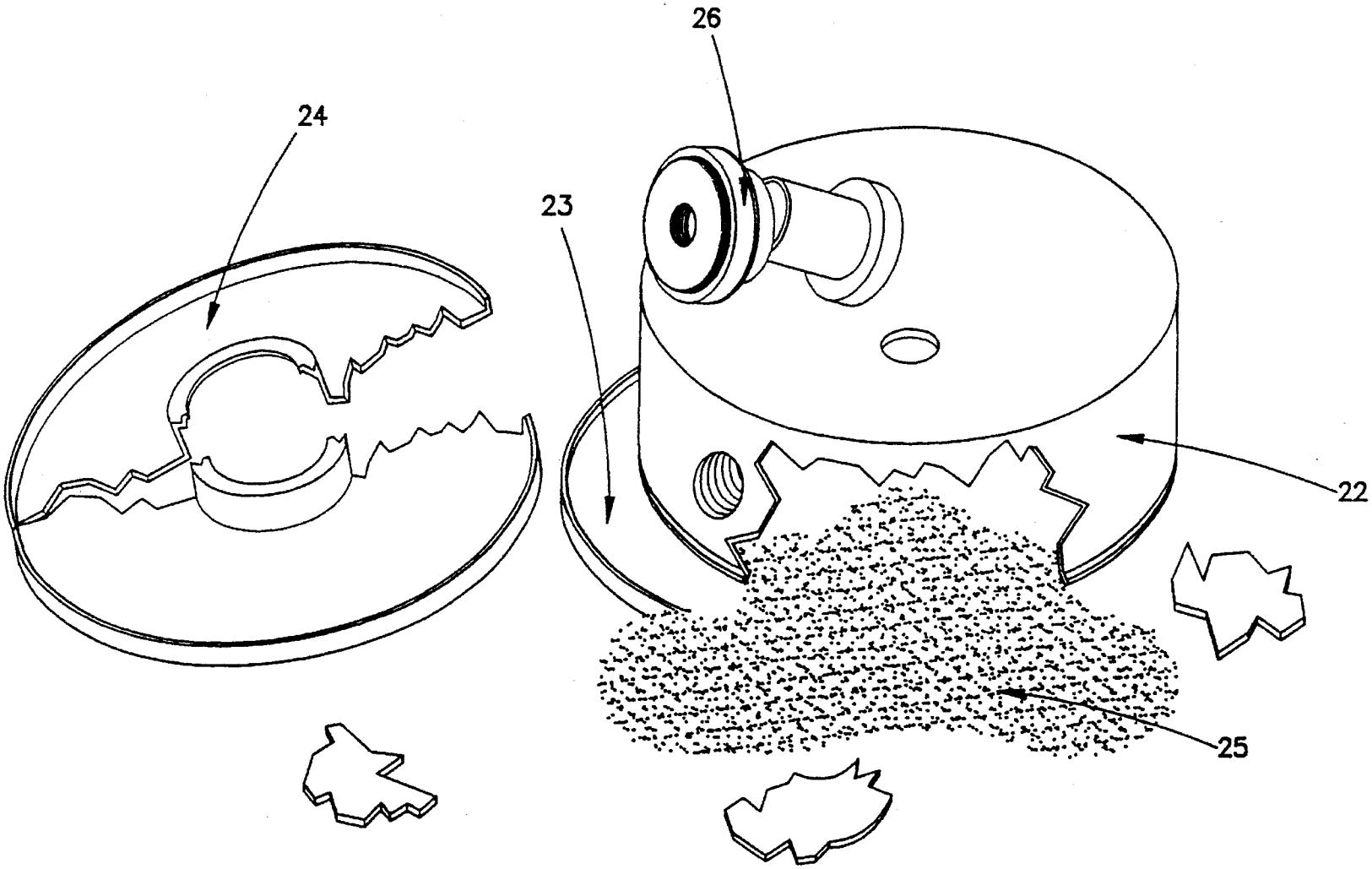
Figure 4:
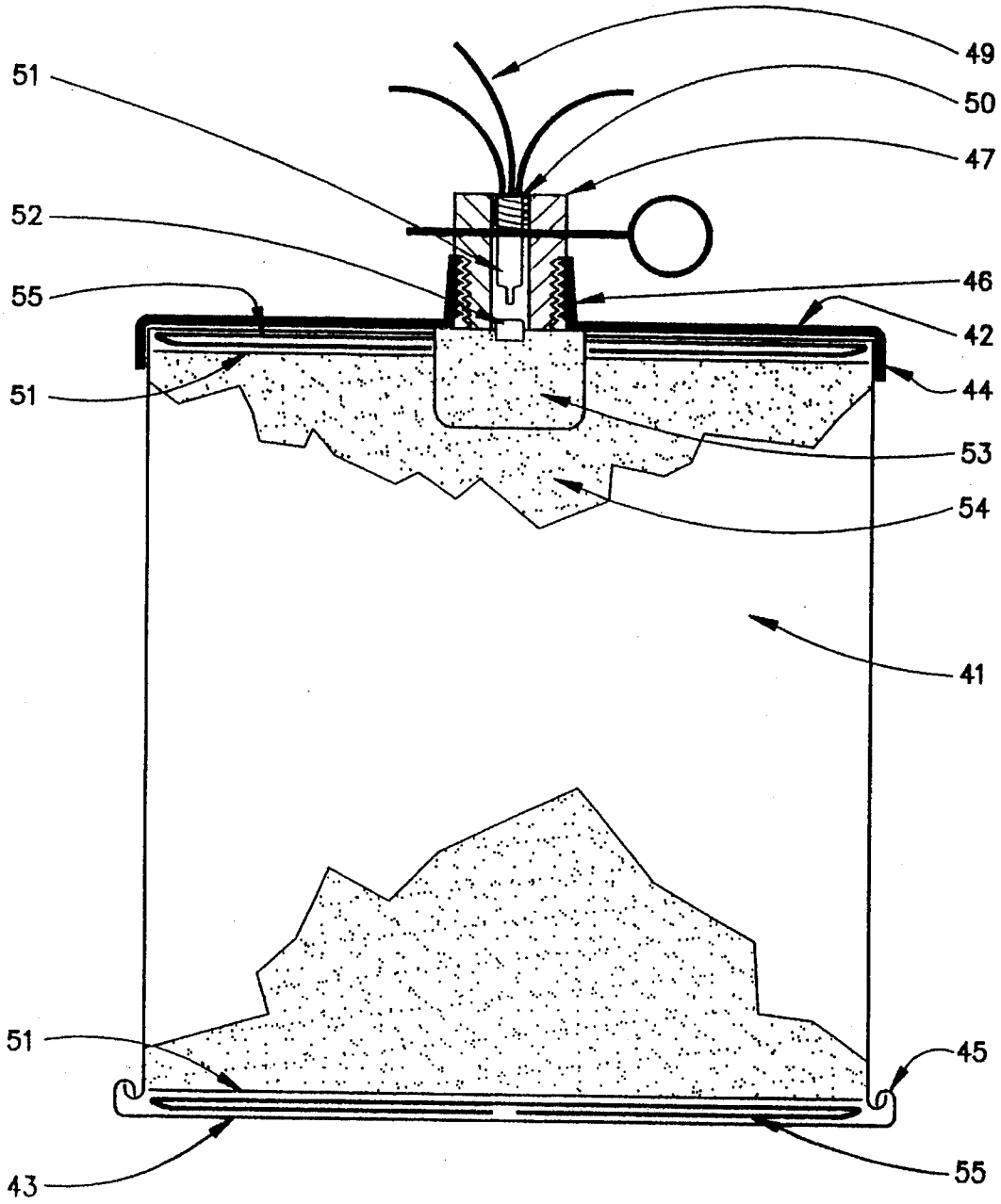

FIG. II is an isometric sectional view of a land mine according to the invention.

FIG. III is a disassociated fragmentation representation of a land mine undergoing rapid degradation and depicting the positive expulsive forces imparted by the separation assist springs.

FIG. IV is a cross-sectional view of an antipersonnel mine according to the invention.

DETAILED DESCRIPTION OF THE PREFERRED EMBODIMENTS

Referring to FIG. I, a point detonating artillery fuze is shown which is comprised in part, of degradable materials. The fuze body 6 and 8 are comprised of a quick-acting, environmentally degradable material as described by this invention. The fuze, as part of an unexploded projectile, will rapidly degrade upon exposure to the environment. Body components 6 and 8 will hastily deteriorate through their exposure to the elements, and begin to fragment, thereby causing the fuze to separate into its major components; 2, 3, 6, and 8. Separation of upper body 6 and lower body 8 enables the firing pin assembly 2 to become disassociated from the detonator 3 and booster charge 10. To aid in the complete separation of the explosive train components resulting from the degradation process, strategically located assist springs, similar to those shown in FIGS. IV, may be incorporated into the design of the fuze. This isolation of the device's major components safely disarms the projectile, rendering it safe to handle and minimizes its potential to detonate.

FIG. II shows an antitank mine with a plurality of its major components comprised of materials from the present invention. Body band 22 is comprised of a degradable plastic material that when exposed to environmental influences, will fragment into a multitude of pieces. The fragmentation of body band 22 will cause end covers 23 and 24 to become disassociated from the main body of the mine. This separation may be assisted by the placement within the body of the mine spring-like devices which will exert continuous outward force until such time as the structural integrity of the body band 22 is unable to contain these forces. An example of an embodiment of the separation assist springs is depicted in FIG. IV., portraying an antipersonnel mine.

The separation of top cover assembly 24 from the main body of the mine will also cause the associated fuze, which in a deployed state would be positioned within fuze well 28, to become free of its secured mechanical attachment to the mine and the other elements comprising the explosive chain. In a similar manner the degradable material may comprise the threaded area and associated body component encompassing booster charge cavity 29. It would not be unexpected for the housing comprising and containing the booster charge to also be fabricated from degradable materials. Generally, as the use of degradable materials increases, the long-term lethality potential of the device decreases.

A supplemental self-destruct fuze may be employed in the secondary fuze well 21 to detonate the mine upon degradation of body band 22.

By having the end covers 23 and 24 extended along the vertical sides of the mine, thereby encompassing much of the surface covered by body band 22, the width of the body band may be greatly reduced in its coverage. A very narrow band of perhaps one-quarter inch in width could be used to hold the two halves of the mine together. The edges of the extended covers and associated band could be fabricated in a manner similar to the edge joints depicted in 44 and 45 of FIG. IV.

Conversely, the entire mine body 20, end covers 23 and 24, arming assembly 26, and the individual fuze components could, in part, or in totality, be comprised of degradable materials to achieve the desired result.

FIG. III shows the antitank mine of FIG. II undergoing neutralization through the deterioration and separation of its components as caused by the use of degradable materials. The use of degradable materials in the composition of end covers 23 and 24 have caused them to become fragmented and displaced. Similarly, arming assembly 26 being comprised of said degradable materials has become separated from its integral association with said antitank mine. Additional effects of the degradation process is shown by said arming assembly separating into its component parts. Body band 22 is shown in an advanced but incomplete state of degradation, which has caused the release of the granular main charge 25.

FIG. IV shows a common antipersonnel mine as embodied by the current invention. The body 41 of the mine is comprised of a degradable material as previously described. Upon deployment and ensuing exposure to the environment, the body housing 41 of the unexploded ordnance begins to degrade. Once body 41 is sufficiently weakened or fragmented, springs 55 forceably assist in the separation of end covers 42 and 43 from body housing 41. Wafers 51 provide a non-sparking barrier and bearing surface for the aforesaid springs to act against. The separation of top cover 42 and attached detonator assembly 47 from the booster charge 53 and main charge 54 effectively and safely deactivates the mine.

A variation of this mine or other munition would be to have threaded flange 46 comprised of a degradable material as herein described and attached to top cover 42. When sufficiently degraded through its exposure to the environment, the flange begins to fragment, thereby losing its mechanical attachment with detonator assembly 47. The effect is to cause the separation of the detonator assembly 47 from the mine, thereby minimizing the likelihood of detonation.

The fabrication of the significant body parts of detonator assembly 47 from the degradable materials of the invention will, upon its exposure to the environment, cause pressure prongs 49, trigger pins 50, firing pin 51, and primer 52, to individually separate.

By utilizing a different detonator assembly with an appropriate firing pin mechanism, the antipersonnel mine of FIG. IV may be caused to detonate upon the degradation of body housing 41, the threaded flange 46, or the detonator assembly 47.

The extent of deactivation or activation through the use of degradable materials is, among other factors, a function of the amount and type of degradable materials used, their placement, and relationship with the other components comprising the device. As herein described, the results are also controlled by the design and type of non-degradable components comprising the munition.

What is claimed is:

1. A munition device for release of an agent selected from the group consisting of an explosive compound, a chemical agent, and a biological agent, wherein the agent is released upon detonation, the device comprising:

(a) a container for housing the agent;

(b) a detonator; and (c) a biodegradable material comprising a biodegradable plastic, the material being integrated into at least one component of the device, wherein when the device is armed and located in an environment and the material is exposed to the environment, the material degrades over a predetermined period of time such that the component is substantially destroyed and the device is inoperative.

2. The munition device according to claim 1, wherein upon exposure to the environment, the biodegradable material causes the component to become dispersed in the environment.

3. The device according to claim 1, further comprising a compressed spring, wherein when the material is at least partially degraded and the component is weakened, stored energy from the spring is released to further destroy the component.

4. A munition device for release of an agent selected from the group consisting of an explosive compound, a chemical agent and a biological agent, wherein the agent is released upon detonation of the device, the device comprising:

(a) a container for housing the agent;

(b) a detonator; and (c) a biodegradable material integrated into at least one component of the device which maintains the device in an armed state but prevents detonation, wherein when the device is located in an environment and the material is exposed to the environment, the material degrades over a predetermined period of time such that the component deteriorates and the device is detonated.

5. The munition device according to claim 4, wherein the biodegradable material comprises a biodegradable plastic.

6. A munition device for release of an agent selected from the group consisting of an explosive compound, a chemical agent and a biological agents wherein the agent is released upon detonation of the device, the device comprising:

(a) a container for housing the agent;

(b) a detonator having a firing mechanism; and (c) a biodegradable material integrated into the device which maintains the device in an armed state but prevents detonation by blocking a passage in the device between the detonator and the container, wherein when the device is located in an environment and the material is exposed to the environment, the material degrades over a predetermined period of time such the firing mechanism can traverse the passage and the device is detonated.

7. The munition device according to claim 6, wherein the biodegradable material comprises a biodegradable plastic.

* * * * *